United States Patent [19]

Mineo

[11] 4,316,318

[45] Feb. 23, 1982

[54] METHOD OF MOUNTING MOUTHPIECE DEVICE OF DRUMS AND LIKE CONTAINERS

[75] Inventor: Kinji Mineo, Tokyo, Japan

[73] Assignee: Yamato Iron Works Co., Ltd., Tokyo, Japan

[21] Appl. No.: 208,419

[22] Filed: Nov. 19, 1980

Related U.S. Application Data

[63] Continuation-in-part of Ser. No. 969,450, Dec. 14, 1978, abandoned.

[30] Foreign Application Priority Data

Dec. 15, 1977 [JP] Japan ..... 52/169115[U]
Dec. 15, 1977 [JP] Japan ..... 52/169116[U]
Aug. 29, 1978 [JP] Japan ..... 53/118850[U]

[51] Int. Cl.[3] ..... B21D 39/00; B23P 11/00

[52] U.S. Cl. ..... 29/512; 29/523; 220/288; 220/304; 285/204; 285/382.4

[58] Field of Search ..... 29/512, 523; 220/288, 220/304, 461, 378; 285/382.4, 382.5, 204, 287

[56] References Cited

U.S. PATENT DOCUMENTS 1,026,423 5/1912 Andrews ..... 29/512 UX
1,395,707 11/1921 Grierson ..... 29/512 UX
2,165,622 7/1939 Donahue ..... 29/512 X
2,187,503 1/1940 Sheridan ..... 285/204
2,267,754 12/1941 Schroeder ..... 220/288 X
2,290,619 7/1942 Rieger ..... 29/512
2,305,197 12/1942 Sheridan ..... 220/304 X
2,485,960 10/1949 Donahue ..... 29/512 UX
3,938,240 2/1976 Holden ..... 29/512

*Primary Examiner*—Charlie T. Moon
*Attorney, Agent, or Firm*—Armstrong, Nikaido, Marmelstein & Kubovcik

[57] ABSTRACT

A method of mounting a mouthpiece onto a container which comprises fitting a tubular mouthpiece having an externally threaded portion and an annular leg portion of reduced thickness at the lower portion of the externally threaded portion, around an upright tubular portion formed integral with a top plate of the container, bending the upper end of the tubular portion outward to cause the bent edge of the upper end to hold the upper end of the mouthpiece from above, pressing outward from inside the lower end of the tubular portion and the said lower end leg portion of the mouthpiece both at a plurality of portions to form a plurality of projections at the lower end of the tubular portion and also the same number of recessed portions in the said leg portion of the mouthpiece, and causing the projections to engage with the recessed portions.

1 Claim, 5 Drawing Figures

METHOD OF MOUNTING MOUTHPIECE DEVICE OF DRUMS AND LIKE CONTAINERS

This application is a continuation-in-part of my prior U.S. application Ser. No. 969,450, filed Dec. 14, 1978, now abandoned.

BACKGROUND OF THE INVENTION

The present invention relates to a method of mounting a mouthpiece to the top plate of containers such as drums.

Already publicly known from U.S. Pat. No. 2,267,754 are methods of mounting a tubular mouthpiece having an externally threaded portion on its external peripheral surface to an upright tubular portion formed on the top plate of a drum. This prior art discloses two methods of fixing an annulus or mouthpiece to a collar or tubular portion of a top plate.

The first method comprises the steps of preliminarily forming recesses or notches in the lower end of an annulus and also embossments at the lower end of a collar, fitting the annulus around the collar with the embossments engaged in the recesses, and bending the upper end of the collar outward, whereby the annulus is fixed to the collar.

The second method comprises the steps of fitting around a collar an annulus preliminarily formed with recesses, and pressing outward from inside and deforming the wall portions of the collar corresponding with the recesses, to form embossments which are to be engaged in the recesses, whereby the annulus is fixed to the collar.

However, according to these conventional two methods recesses should preliminarily be formed in the lower end of the annulus in any case. Consequently, it is combersome to design and manufacture the die for producing the annulus, which will entail a high production cost of the annulus.

Especially, since the first method necessitates a positioning operation between the collar and the annulus to successfully interlock the embossments with the recesses, the fixing work requires much labor. Further, now that the second method needs exactly strike-up toward the recesses the portions in the lower end of the collar in compliance with the recesses, the fixing work is still troublesome.

Anyhow, there is a problem that the foregoing conventional methods find a difficulty in automatically effecting the fixing work of the annulus or mouthpiece to the collar or tubular portion.

SUMMARY OF THE INVENTION

The object of this invention is to overcome the foregoing problem and to provide a method of mounting a mouthpiece of the external thread type to a top plate of drums and like containers.

A feature of the present invention is a method of mounting a mouthpiece onto a container which comprises fitting a tubular mouthpiece having an externally threaded portion and an annular leg portion of reduced thickness at the lower portion of the externally threaded portion around an upright tubular portion formed integral with a top plate of the container, bending the upper end of the tubular portion outward to cause the bent edge of the upper end to hold the upper end of the mouthpiece from above, pressing outward from inside the lower end of the tubular portion and the said lower end leg portion of the mouthpiece both at a plurality of portions to form a plurality of projections at the lower end of the tubular portion and also the same number of recessed portions in the said leg portion of the mouthpiece, and causing the projections to engage with the recessed portions.

The method of the present invention can afford the following effects which can never be expected from the said prior art.

First, since an annular leg portion of reduced thickness is formed at the lower portion of the externally threaded portion of the mouthpiece, the leg portion deforms more easily when pressed together with the lower portion of the tubular portion, whereby the recesses engaging with the outward projections of the tubular portion can be formed in the leg portion. Consequently, on fixing a mouthpiece to a top plate, there is entirely no need of relatively positioning between the mouthpiece and the tubular portion, which will greatly facilitate the fixing work of the mouthpiece and further make it possible with ease to do this fixing work automatically.

Second, the mouthpiece may be merely of tubular shape and needs not be preliminarily formed with recesses, so that it can be easily prepared from cheap material, for example, tubular steel material cut to a desired length from a steel pipe and therefore be produced at extremely low cost.

Third, the annular leg portion of reduced thickness is provided at the lower portion of the mouthpiece such that the former is more depressed inwardly than the externally threaded portion. Thus, after a cap is placed on the mouthpiece in screw-thread engagement, a cap seal can be fitted over the cap firmly enough to hardly strip off only if pressed toward the outer surface of the leg portion at the lower edge portion of its peripheral wall.

DESCRIPTION OF THE PREFERRED EMBODIMENT

Figure 1:
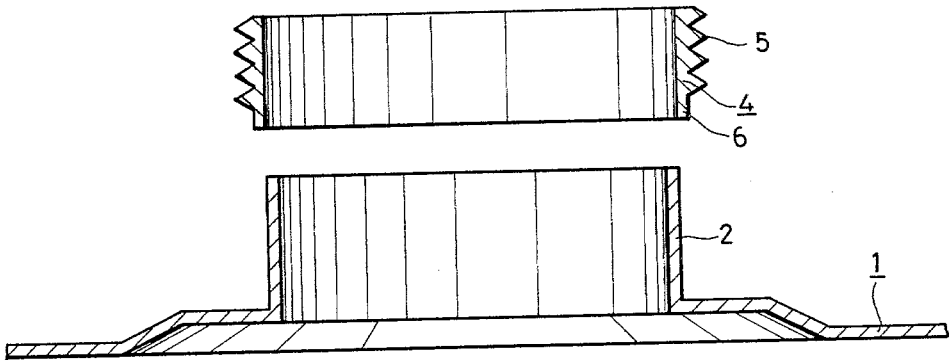
FIGS. 1 to 3 explain in order how to mount a mouthpiece to a top plate of a drum according to the present invention.
Figure 2:
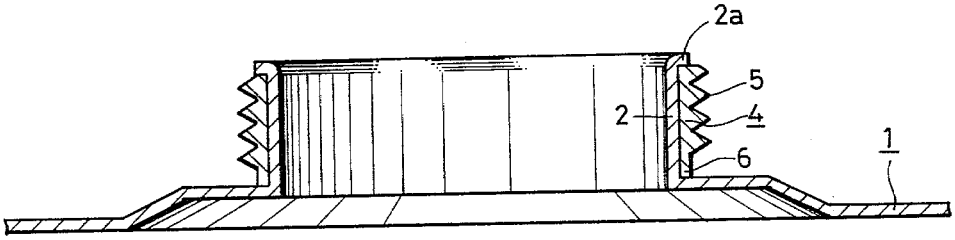
Figure 3:
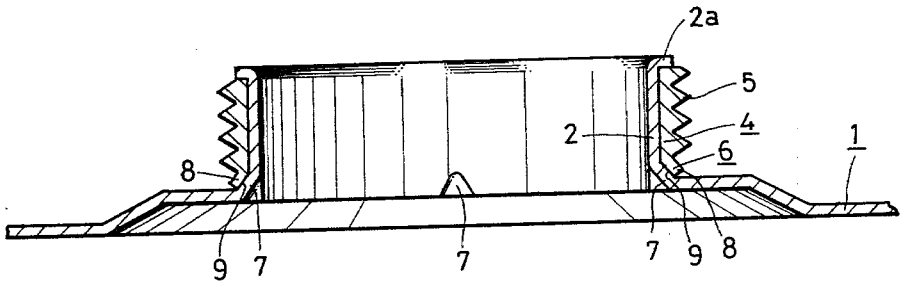

With reference to FIGS. 1 to 3, a steel top plate 1 of a drum is integrally formed with an upright tubular portion 2 at a specified portion. Prepared is a tubular mouthpiece 4 having an annular leg portion 6 of reduced thickness provided at the lower portion of the externally threaded portion 5 (see FIG. 1). This mouthpiece 4 can be mass-produced at extremely low cost from, e.g., a steel pipe by cutting the steel pipe to a determined length, and forming an externally threaded portion 5 and an annular leg portion 6 on each tubular cut piece. Then the tubular mouthpiece 4 is firmly fitted around an upright tubular portion 2 of a top plate 1 against rotation by mounting the mouthpiece 4 on the tubular portion 2, bending the upper end of the portion 2 outward to cause the bent edge 2*a* to hold the upper end of the mouthpiece 4 from above (FIG. 2) and pressing the lower end of the tubular portion from inside outward at a plurality of locations to thereby simultaneously form outward projections 7 and 8 on the upright portion lower end and on the annular leg portion 6 of the mouthpiece 4 respectively, causing the outward projections 7 of the tubular portion 2 to fit to the inner surfaces of the mouthpiece projections 8, namely to recessed portions 9 (FIG. 3).

Figure 4:
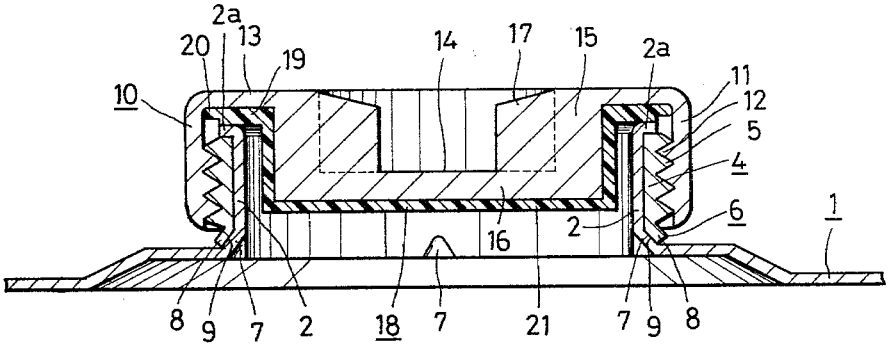
FIG. 4 is a view in longitudinal section showing part of an embodiment of mouthpiece device which includes a mouthpiece mounted to a top plate according to the present invention, a cap provided with a packing being placed on the mouthpiece.

FIG. 4 shows an embodiment wherein the tubular mouthpiece 4 mounted to the upright tubular portion 2 of the top plate 1 according to the present invention, is covered with a cap 10 having an inverted hat-shaped packing 18.

A cap 10 of die-cast zinc alloy fitting over the fixed mouthpiece 4 in screw-thread engagement therewith includes a vertical peripheral wall 11 internally threaded as at 12 and a top wall 13 centrally formed with a cavity 14. A pair of projections 17 adapted for engagement with a cap opening tool are opposed to each other within the cavity 14 and are integral with a peripheral wall 15 and bottom wall 16 defining the cavity 14. A plug opening wrench conventionally used for drums is usable as the cap opening tool.

The cap 10 is provided on its inner side with a packing 18 in the form of an inverted hat. The packing 10 comprises an annular seal portion 19 having a large thickness and fittable to the inner surface of the peripheral portion of the cap 10, an annular outward projection 20 of reduced thickness extending integrally from the outer periphery of the annular seal portion 19 and engageable with the upper edge of an internally threaded portion 12 on the inner side of the cap 10 for retaining the packing on the cap, and a covering portion 21 of reduced thickness extending from the inner periphery of the annular seal portion 19 and ⊔-shaped in cross section for covering the inside surfaces of a peripheral wall 15 and a bottom wall 16 defining a cavity 14 in the center of the cap 10 adapted for receiving a cap opening tool therein. The inverted hat-shaped packing 18 is fittable to the inner side of the cap 10 by a single action and retainable thereon without slipping off to completely seal off the mouthpiece portion of the drum with extreme ease. The packing 18 is adapted to cover almost the entire inner surface of the cap 10 and is therefore very advantageous to use for example on a drum which is lined with a resin coating.

The outward projection for holding the packing 18 in place against slipping off is not limited to the annular one described above but may alternatively comprise a plurality of tonguelike projections arranged as spaced apart from one another.

Figure 5:
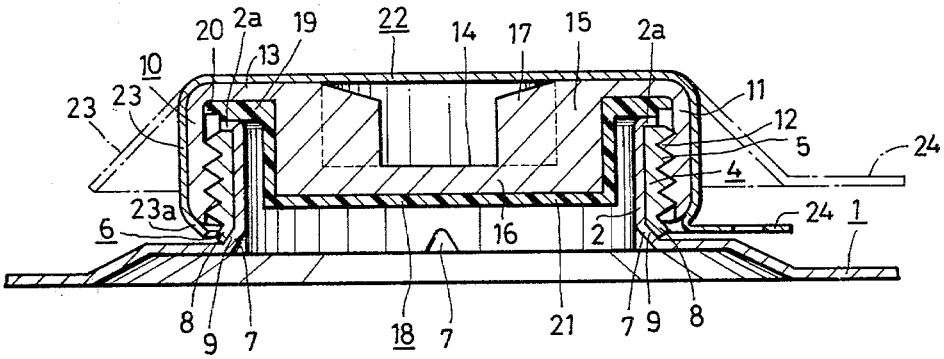
FIG. 5 is a view in longitudinal section showing part of another embodiment wherein a cap seal is fitted over the mouthpiece device of FIG. 4.

FIG. 5 shows another embodiment where a cap seal 22 is fitted over the mouthpiece device of FIG. 4. This cap seal 22 is made of for example a steel, aluminum or like metal sheet. As indicated by a dot-and-dash line, a cap seal 22, after placed on a cap 10, is pressed at the lower edge portion 23*a* toward the outer surface of the leg portion 6 of the mouthpiece 4, whereby the cap seal 22 can be fitted over the cap firmly enough to hardly strip off. Consequently, when it is required to remove the cap seal 22, a projection 24 provided at one end of the cap seal 22 must be pulled by for example pincers or the like to tear the cap seal away.

The cap 10 which is made of die casting zinc alloy may be made from an aluminum alloy by die casting or formed from a synthetic resin or some other material. The annular packing 18 may be made of a syntheric rubber, synthetic resin, or some other material depending on the contents of the drum. A packing of circular or rectangular cross section may be usable as the annular packing 18.

Although embodiments of the invention have been described above as used for drums, the method of this invention are similarly applicable to other containers.

This invention may be embodied differently without departing from the spirit and basic features of the invention. The embodiments herein disclosed are given for illustrative purposes only and are in no way limitative. It is to be understood that the scope of the invention is defined by the appended claims rather than by the specification and that various modifications within the scope and definition of the claims are included in the claims.

What is claimed is:

1. A method of mounting a mouthpiece onto a container, comprising fitting a tubular mouthpiece having an externally threaded portion, around an upright tubular portion formed integral with a top plate of the container and fixing the former to the latter as they stand, wherein the improvement comprises:

(a) preparing a tubular mouthpiece having an annular leg portion of reduced thickness at the lower portion of the externally threaded portion;

(b) fitting the thus prepared tubular mouthpiece around the upright tubular portion of the top plate and bending the upper end of the tubular portion outward to cause the bent edge of the upper end to hold the upper end of the mouthpiece from above;

(c) pressing outward from inside the lower end of the tubular portion and the said lower end leg portion of the mouthpiece both at a plurality of portions to form a plurality of projections at the lower end of the tubular portion and also the same number of recessed portions in the said leg portion of the mouthpiece; and (d) fixing the mouthpiece to the tubular portion by the engagement of the projections with the recessed portions.

* * * * *